United States Patent [19]

Lante-Montefeltro Della Rovere

[11] 4,205,651

[45] Jun. 3, 1980

[54] AUTOLOADING TARGET-PIGEON LAUNCHER

[76] Inventor: Ludovico Lante-Montefeltro Della Rovere, Avenida Paez Quinta Ismenia, Caracas, Venezuela

[21] Appl. No.: 892,922

[22] Filed: Apr. 3, 1978

[51] Int. Cl.[2] ..... F41B 15/00

[52] U.S. Cl. ..... 124/1; 124/34; 116/303; 124/40; 116/137 R; 124/51 R; 124/43

[58] Field of Search ..... 124/6, 54, 32, 34, 41 R, 124/41 B, 42, 51 R, 1, 31; 46/82, 83, 84, 85; 273/105.4

[56] References Cited

U.S. PATENT DOCUMENTS

| | | | |
|---|---|---|---|
| 542,377 | 7/1895 | Shattuck | 124/1 |
| 3,570,467 | 3/1971 | Belokin | 124/41 R X |
| 4,077,384 | 3/1978 | Montefeltror | 124/32 X |

FOREIGN PATENT DOCUMENTS

| | | | |
|---|---|---|---|
| 516942 | 1/1931 | Fed. Rep. of Germany | 46/84 |
| 980920 | 1/1965 | United Kingdom | 124/6 |

*Primary Examiner*—William R. Browne
*Attorney, Agent, or Firm*—Karl F. Ross

[57] ABSTRACT

A launcher for a target pigeon having a central coreless ring and a pair of propeller-type vanes projecting therefrom has a launch head whose tip can be rotated about a head axis for spinning a target pigeon held on the tip by a pair of retractable holding fingers. This head can be swiveled about a horizontal axis from an upwardly directed launch position into a downwardly directed load position in which it is aligned with a stack of such pigeons carried on a vertically displaceable platform, while in the launch position the entire head is also oscillated about a vertical axis. The launch tip has a radially displaceable beak which is urged centrifugally outwardly to deflect a target pigeon that is released from the launch tip by retraction of the holding fingers by a solenoid, and which also is urged radially inwardly by a spring so that when the tip is not rotating during loading the beak is out of the way. The platform carrying a stack of pigeons is vertically stepped to press the uppermost pigeon of the stack over the launch tip of the head when it is in the load position.

25 Claims, 13 Drawing Figures

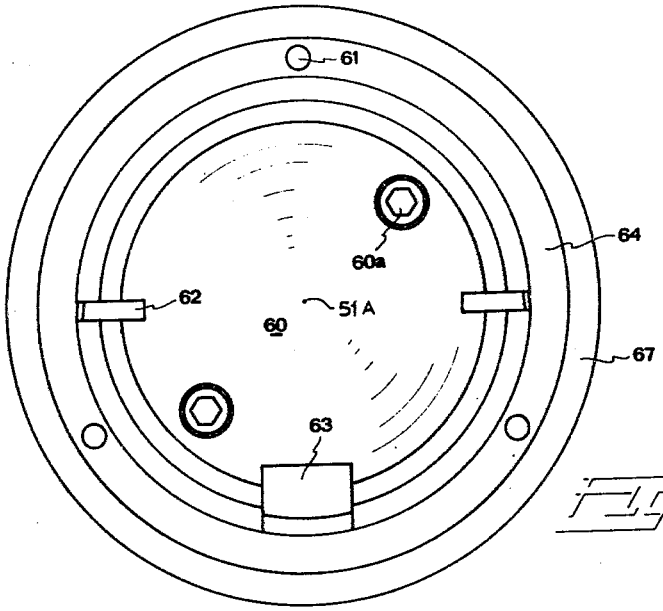
Fig. 3
Fig. 8
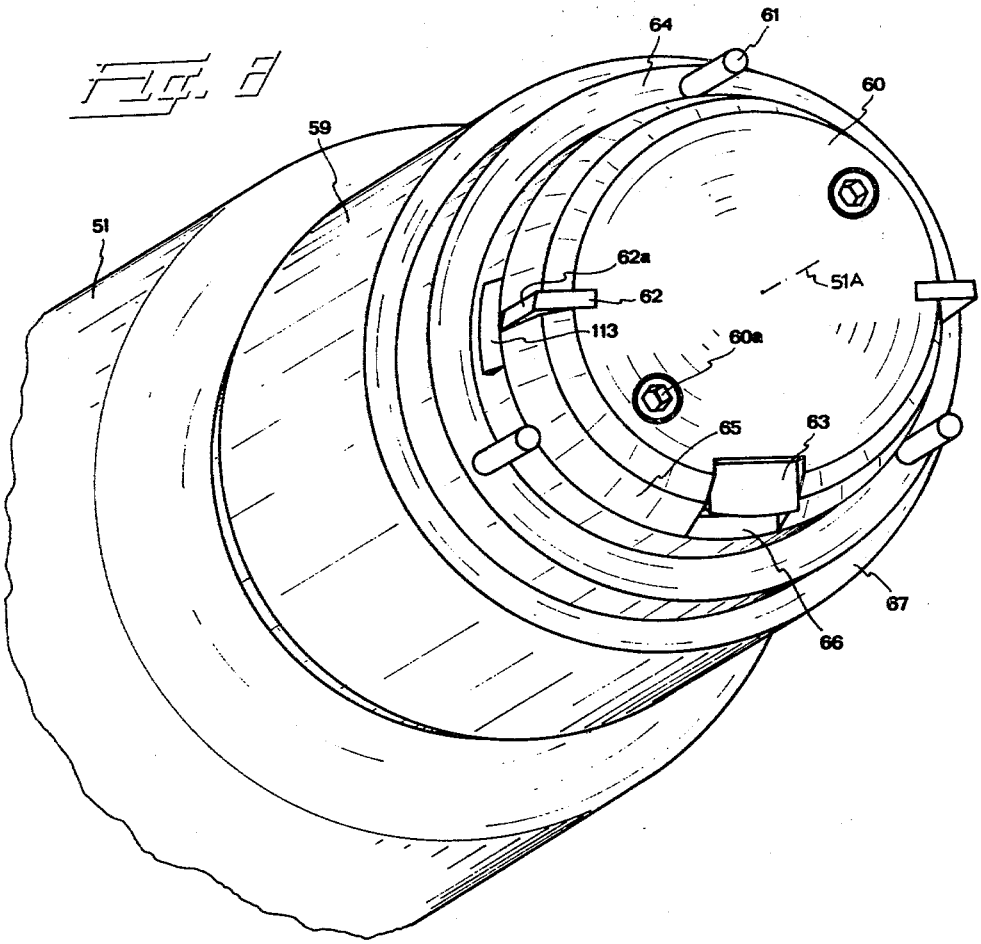

AUTOLOADING TARGET-PIGEON LAUNCHER

FIELD OF THE INVENTION

The present invention relates to a target-pigeon launcher. More particularly this invention concerns a target-pigeon launcher capable of loading itself.

BACKGROUND OF THE INVENTION

A target pigeon of the so-called Pro ZZ type and a launcher therefor of the Montefeltro 75 type are known from commonly owned U.S. Pat. No. 4,077,384 issued Mar. 9, 1978 on an application filed June 3, 1976 as a continuation-in-part of application Ser. No. 604,069 filed Aug. 12, 1975 (now abandoned), and Ser. No. 762,019 filed Jan. 24, 1977 (now U.S. Pat. No. 4,133,532), both of whose disclosures are herewith fully incorporated by reference.

The system described in the above-identified applications and patent has proven to be an enormous improvement over the target-pigeon-launching machines known hitherto, as stated in some detail in *Field and Stream* of August 1977 at pages 102 ff. The complete system constitutes a shooting sport that is felt to compare favorably with wing shooting, and at the same time has the advantages of being legal virtually everywhere, which wing shooting is not, of being unobjectionable on ecological or ethical grounds, and being considerably cheaper than wing shooting.

The system has one main failing: it requires someone to attend and reload the machines. This has been necessary because the standard so-called Pro ZZ target pigeons each comprise a separate witness disk which is cup-shaped and secured by outwardly deflectable feet to a ring from which extend two diametrically opposite propeller-type vanes. A web diametrically bridging the ring is formed centrally with a doubly outwardly flared throughgoing hole and radially offset from this hole with two further recesses. A central beak of the launch head of the launcher must be fit through the cental hole and entrainment pins must be fitted into the recesses. Thus when the launch head rotates the entrainment pins will rotationally entrain the entire pigeon. When the pigeon is pushed off the beak a laterally projecting tip thereof laterally deflects the pigeon in a manner impossible to predict so that the trajectory of the pigeon resembles the random flight pattern of a flushed bird.

Furthermore in the known system positive locking means is provided in the form of two radially displaceable balls in the beak of the launch head. Thus to load a pigeon on the launch head the loader must operate a button to retract the balls of the positive locking system, then twist the pigeon over the beak and align the recesses with the entrainment pins, and finally release the knob to lock the pigeon in place. Although numerous attempts have been made, no machine has hitherto been designed that can perform this relatively complex succession of steps to load a pigeon on such a launching machine.

In the commonly owned and copending application Ser. No. 882,907 filed Mar. 1, 1978, whose entire disclosure is herewith incorporated by reference, a new target pigeon is shown and described which represents a considerable advance over the Pro ZZ pigeon, in that it can be reused, which the Pro ZZ pigeon cannot. Thus operating costs are reduced enormously, but the arrangement still requires at least one loader per range.

Such manual loading of the machines not only has the considerable disadvantage of entailing considerable labor expenses, but also requires a shooting range embodying the Montefeltro 75 equipment to be of relatively expensive construction, as a pit sufficiently deep to protect the loaders must be provided behind the arcuate array of launchers whose center is at the shooter's stand. If no such pit or ditch is provided, it is necessary for the shooter to open his piece, in accordance with proper shooting safety, for the loader to cross the field and reload the launcher that just operated. Thus considerable time, often at least a minute, must elapse between successive shots.

OBJECTS OF THE INVENTION

It is therefore an object of the present invention to provide an improved launcher.

Another object is to provide an autoloading launcher which overcomes the above-given disadvantages.

A further object is the provision of an improved fast-operating shooting system which is autoloading and which can operate completely without supervision, so that the shooter can virtually be left alone on the range.

SUMMARY OF THE INVENTION

These objects are attained according to the invention in a machine which is adapted to operate with the new coreless flying target pigeons of the improved so-called Universal type described in the jointly filed and copending U.S. patent application Ser. No. 892,921. Such a coreless pigeon does not have a transverse web as did the hitherto used Pro ZZ or unbreakable pigeons, but instead is set up so that the launch tip of the launch head can grip the interior of the ring carrying the propeller-type vanes. Furthermore this pigeon has a cylindrically stepped witness disk whose small-diameter outer or upper portion is adapted to nest loosely in the ring of an overlying pigeon in a stack of such pigeons.

The machine according to this invention has a launch head which can pivot between an upwardly directed launch position and a downwardly directed loading position. In the upwardly directed position the head can be spun, and positive locking means in the form of radially displaceable fingers can hold the pigeon in place until it is to be launched.

According to a futher feature of this invention the above-described laterally projecting beak, which is essential for deflecting the pigeon as it is released so that it follows a lifelike trajectory, is withdrawn radially inwardly during loading of a target pigeon over the launch tip so that the loading means itself can merely press such a pigeon axially over the head, and need not tip and align the target pigeon to clear the beak as in the prior art. In accordance with a particularly advantageous feature of the invention this radial displacement of the beak is effected by centrifugal force, that is the beak is radially displaceable on the head and is urged by a relatively weak spring radially inwardly so that when the head is not rotating the beak automatically retracts radially inwardly into a position that allows a new pigeon to be mounted on the launch tip. This beak is relatively massive and is positioned wholly to one side of the rotation axis of the head, so that when the head is spun, at a speed variable up to 8000 RPM, the centrifugal force urging the beak radially outwardly is enormous and more than sufficient to assure positive deflection of the pigeon as it leaves the head.

In accordance with further features of this invention the loading means constitutes a platform adapted to support a stack of nested upside-down pigeons, and means for vertically stepping this platform upwardly toward the launch head. The stepping or indexing means is set up so as to move the entire stack up a full step, then back a fractional step for each loading cycle. Thus the uppermost pigeon will be pressed onto the downwardly directed launch tip of the launch head oriented in the loading or charging position, and thereafter the entire stack will drop a small distance away from the picked-up pigeon so that it can be laterally swung aside as the launch head swivels or pivots into the launch position. Even though the stack of pigeons is nested together, this type of feed of the stack assures that the uppermost picked-up pigeon will be completely separated from the uppermost pigeon in the underlying stack.

According to a further feature of this invention the entire head and magazine of target pigeons is oscillated about a vertical axis which is coplanar with the rotation axis of the head and which is coaxial therewith when the head is in the loading position. The horizontal pivot axis about which the head swivels between the loading and launch positions is perpendicular to the head rotation axis and to the vertical oscillation axis.

The locking means, which operates to positively hold the target pigeon on the launch head and prevent premature departure of the pigeon therefrom, is constituted by a pair of fingers having outer ends displaceable between protruding or extending positions and retracted positions. A solenoid built right into and rotatable with the launch tip is constituted by a coil fixed in the body of the launch tip and a plate rotatable jointly with but axially displaceable relative to this launch tip. A pair of axially extending pins each have a pointed cam end engaging a respective aperture or similar cam formation in the respective finger so when the coil is energized this plate or armature is attracted and the pins are displaced to cam the fingers inwardly. Furthermore according to the invention ejector bodies are provided on the launch tip which are biased continuously axially outwardly and bear on the ring of a pigeon carried on the launch head. Thus once the fingers retract to release the pigeon these ejector bodies or pins push the target pigeon off the launch tip, assisting its natural lift or tendency to fly off due to its propeller action.

The entire device may be operated according to the invention from a remote master controller as described in the above-cited copending applications. Thus a plurality—three or five—of the machines is normally arranged in an arcuate array centered on a shooter's stand spaced between 20 and 30 meters from the machines. The master controller is set up to fire one of the machines, at random, so that the shooter cannot guess which launcher the target pigeon will rise up from, exactly as in box-type wing shooting. In order best to resemble such wing shooting the launchers are each provided with an upstanding plate or gate that drops an instant before the target pigeon is launched, so as to give the shooter a slight warning. In a manner similar to that of the above-mentioned application Ser. No. 679,135 the gate is dropped by remote control on that machine that the master controller has selected at random. Thereafter switches operated by the falling gate and by other mechanism in the individual launcher itself control the sequence of operation of the machine. Before the gate can fall the oscillating motor in the machine base and the spin motor in the head must both be operating, the gate of course must be up, and the head must be in the launch position. A microswitch operated by the gate at the very start of its fall operates the release solenoid of the positive locking means so as to release the pigeon. When the gate is all the way down it operates another switch which depressurizes a pneumatic cylinder that maintains the head in the launch position so this head can automatically return by gravity to the load position.

The head itself or mechanism that moves with it closes another switch when in the load position to displace the platform carrying the stack of pigeons a full step up so as to fit the uppermost pigeon over the tip, which is not rotating because the oscillation and spin motors have both been automatically shut off by yet another switch as soon as the head moved out of the launch position. The platform or its displacement mechanism in turn automatically drops back a half or fractional step and in turn depressurizes the cylinder that pushed the gate down, so that this gate will return to the up position, which action automatically operates yet another switch to allow pressurization of the launch cylinder to displace the launch head into the launch position. In this condition the apparatus is ready to fire another target pigeon off. In practice it has been found that the entire cycle can take place is a mere 8 seconds, so that extremely fast and lively shooting is possible. It goes without saying that if the target pigeons of the coreless type described in the above-cited application are of the reusable type, made of durable high-impact synthetic-resin material and built so as to deflect or shed pellets, such a sport can be relatively economical, while providing shooting practice that closely resembles field wing shooting.

In accordance with a further feature of the invention the stepping means for the platform supporting the stack of pigeons is formed by at least one vertically steppable rack and one fixed rack. The platform has a pair of latch bolts each engaging a respective one of these racks so that as the movable rack is stepped the two latches will move upwardly, but when the movable rack moves back down only its respective latch pin will move inwardly. The end faces of these latch bolts are inclined so that relative motion between them and the respective racks in one direction will merely cam them inwardly against their respective biasing springs, but relative motion in the opposite direction is impossible unless the bolts are retracted. Furthermore the stepping means is a pneumatic or hydraulic cylinder operatively connected to the movable rack and pressurizable to displace the respective rack and therefore the platform, upwardly through a complete step which is somewhat longer than the vertical spacing between adjacent teeth or spaces of the fixed rack so that when depressurized the platform drops back down a short distance equal to slightly more than the height of the above-described upper stepped portion of the witness disk of one of the target pigeons.

The device of this invention therefore functions completely automatically. It can be loaded with a large number, at least fifty, of target pigeons and will launch them one-by-one until the magazine is depleted, at which time an indicator may signal that a new supply is needed. Operating as described above with an 8 second cycle, a single machine having a magazine of 50 pigeons will take 6.6 minutes to empty itself when operating at top speed. Since these machines are intended to be used in groups of three or five, firing at random, the overall shooting time between reloadings of the machines is correspondingly multiplied. Also it is clear that the rack holding the supply of pigeons can be increased in capacity at very little additional cost to double or even triple the capacity of each machine, merely by making it vertically longer.

BRIEF DESCRIPTION OF THE DRAWING

FIG. 8 is a perspective large-scale end view of the launch head;

FIG. 9 is an axial end view of the launch head;

DETAILED DESCRIPTION OF THE PREFERRED EMBODIMENT

Figure 1:
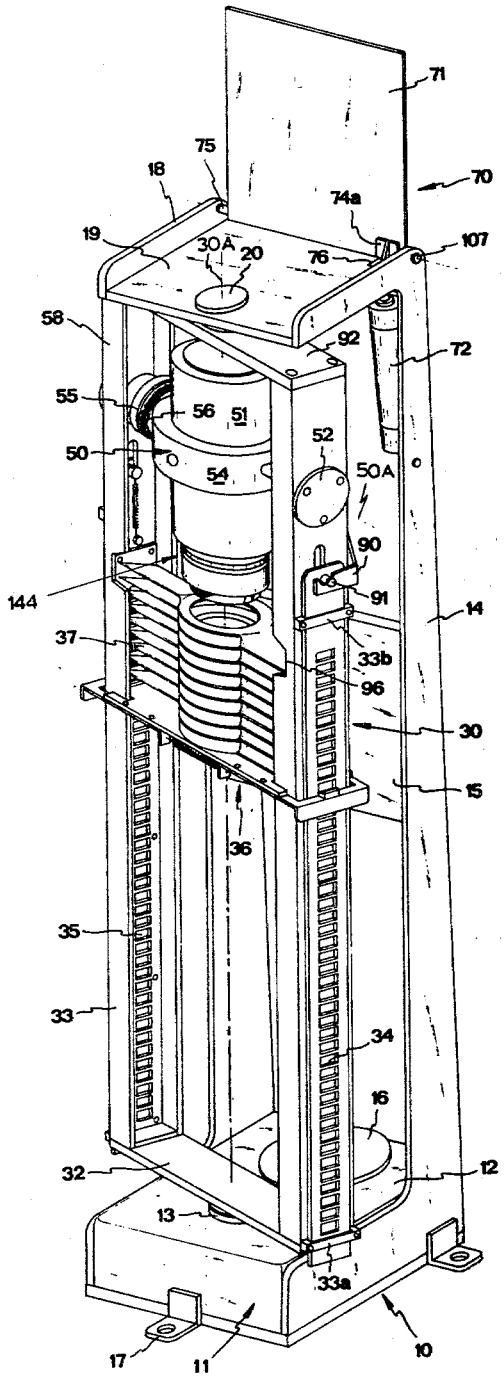
FIG. 1 is a front perspective view of the autoloading target-pigeon launcher according to the instant invention, in the loading position.
Figure 2:
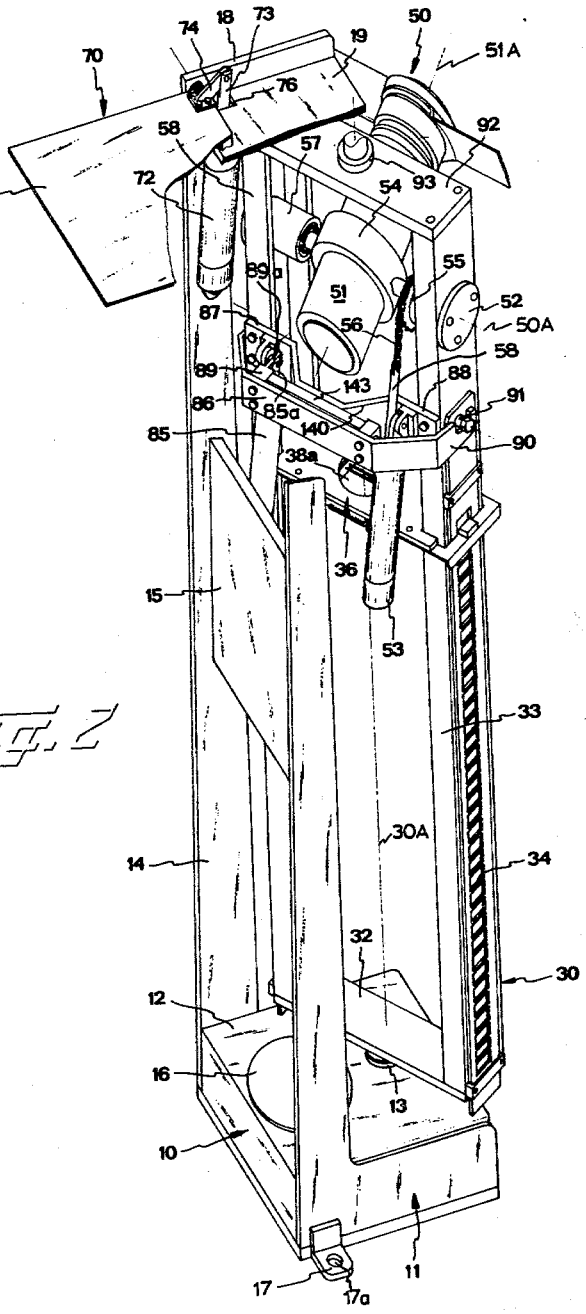
FIG. 2 is a partly broken away rear perspective view of the launcher immediately prior to launching of a target pigeon.

The launching apparatus of this invention is constituted as shown in FIGS. 1 and 2 by an upright frame standing vertically on a base 11 forming a lower housing closed by a cover 12. A bushing 13 receives an upright axle 31 (FIG. 3) extending upwardly from the cover 12 and carrying an upright rack 30. A pair of side vertical posts 14 extend upwardly from the base 11 and are connected at their upper ends by a vertical plate 15. A launching head 50 is supported on the top end of the rack 30 for rotation about a horizontal axis 50A between an upper almost vertical launch position shown in FIG. 2, and a lower loading position shown in FIG. 1. At the top end of each of the frame posts 14 a forward extension 18 supports a respective side of a cross horizontal platform 19, provided with a visual signaling arrangement 70. The platform 19 also carries a pivot 20, vertically aligned on an axis 30A with the bushing 13 and forming the upper pivot for the rack 30.

Figure 3:
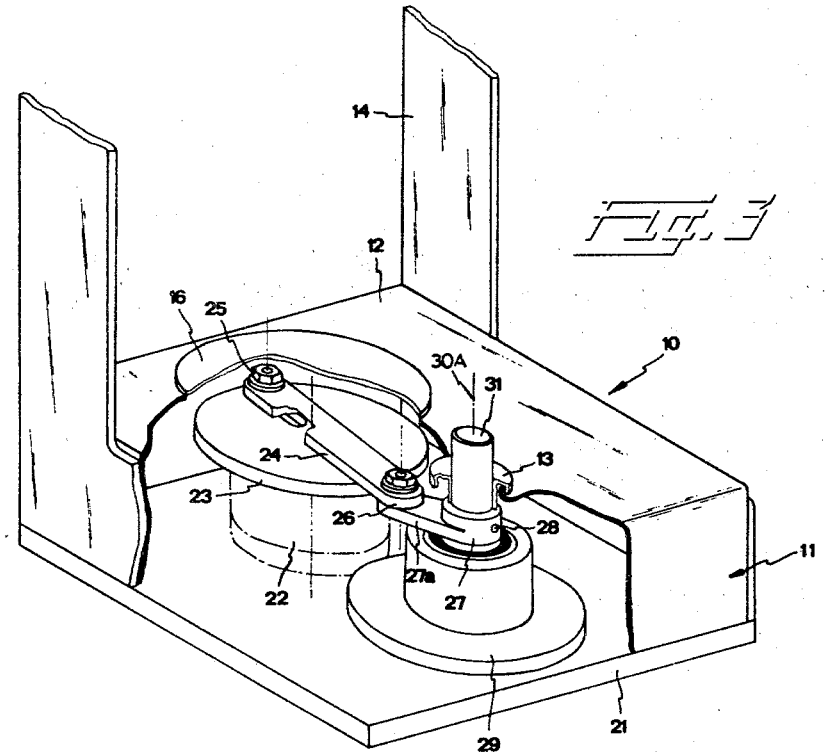
FIG. 3 is a partly broken away front perspective view of the base of the launcher.

The base 11, as best shown in in FIG. 3, is comprised by a bottom rectangular plate 21 on which the entire assembly stands. This bottom plate 21 is closed by the cover 12, and flanked by the lower ends of the vertical posts 14. About at the ceneter of the cover 12, and at the side thereof distal the posts 14, an aperture is provided fitted with the bushing 13 through which the vertical axle 31 protrudes. A removable cover plate 16 is also provided on the cover 12, to give access to the interior of the base 11.

Within the housing or base 11 there is provided an assembly to produce the oscillating motion about the axis 30A of the rack 30 with the head 50 and with the stack of target pigeons carried on the rack 30. This oscillating movement is to be effected concurrently with rotation of the head 50 about an axis 51A to obtain combined rotation and back-and-forth movements for the launching tip of the head and the target pigeon connected thereto.

This oscillating drive is constituted by a motor-reductor unit 22 to whose output shaft a circular disk 23 is connected for rotation therewith. The disk 23 in turn is connected pivotally to a connecting rod 24 whose one end is connected to a crank pin 25 near the periphery of the disk 23. The other end of the connecting rod 23 is pivotally connected at 26 to a crank arm 27*a* of a sleeve 27 fixed on the lower end of the axle 31. The axle 31 and the sleeve 27 are connected firmly to each other by means of a bolt 28, and both are supported on a journal 29 carried by the bottom plate 21. Thus as the motor-reductor unit 22 rotates the disk 23 the connecting rod 24 and the arm 27*a* of the sleeve 27 translate the rotation of the disk 23 into a back-and-forth movement of the axle 31 about the axis 30A and, consequently, also oscillate the rack 30 and head 50.

At least on three sides of the housing 11, there are provided L-shaped flanges 17 extending laterally at the same level as the bottom plate 21 and formed with holes 17*a* adapted to receive bolts or the like to secure the frame 10 on a suitable base (not shown). Thus the entire apparatus can be firmly anchored to the floor or other base surface.

Figure 6:
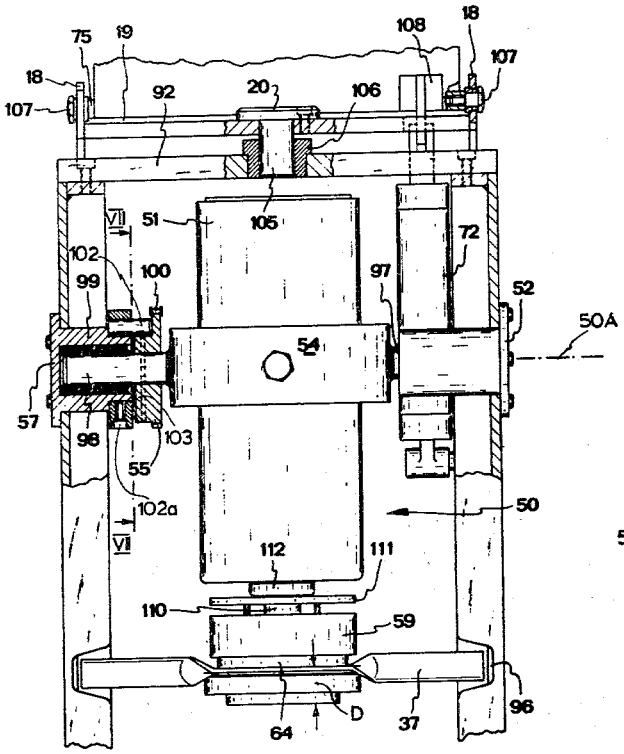
FIG. 6 is a partly sectional front view of the launch head in the loading position.

The rack 30 comprises a rectangular vertically elongated frame constituted by a bottom plate 32 which is fixed to the protruding upper end of the axle 31 so that the oscillatory motion of the axle 31 can be transmitted to the rack 30. From the bottom plate 32 a pair of U-section side beams 33, one at either side of the plate 32, extend upwardly parallel to each other, and at the top end of these beams 33 a cross top plate 92 closes the rectangle thus formed. The top plate 92 is provided as seen in FIG. 6 with a short axle 105 and a bearing 106 forming the pivot 20 and lying on the axis 30A.

Along a substantial length of each beam 33, an outer rack 34 is slidably secured by clamping devices 33*a* and 33*b* (FIG. 1), respectively located at the bottom and at the top of these beams 33. The outer racks 34 are parallel to and contiguous with the web portion of the respective U-section beams 33. Also parallel and contiguous to these web portions, but opposite to the outer racks 34, are inner racks 35 firmly fastened thereto.

Figure 4:
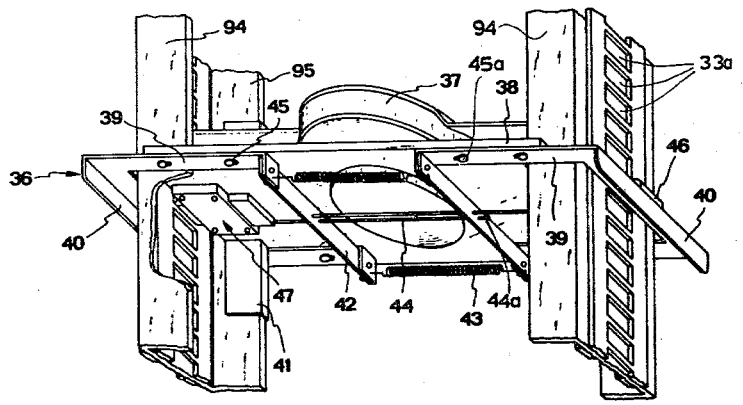
FIG. 4 is a partly broken away perspective view of the magazine platform of the launcher.
Figure 5:
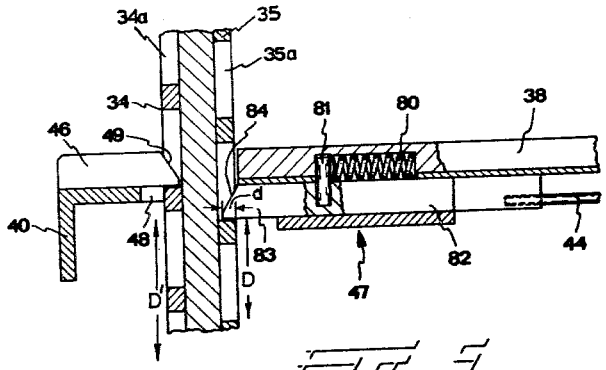
FIG. 5 is a large-scale section through a detail of FIG. 4.

As best shown in FIG. 4 and FIG. 5 a vertically movable platform 36 spans the space between the two side beams 33 and has a vertical U-section rail 41 embracing one of the rails 33 to maintain the platform 36 perpendicular to the axis 30A. A weight-supporting plate 38 forming the platform 36 is arranged to carry a stack of flying target pigeons 37. To this end the plate 38 can be lowered to the very bottom of the frame 30 until it rests on the bottom plate 32. In this position, it can be loaded with the stack of pigeons 37, with the propellers thereof engaging between the flanges 94 and 95 of the U-section beams 33 and the witness disk of the lowermost pigeon 37 engaged in a circular central hole 38*a* in the plate 38 so the pigeons 37 are maintained in a predetermined position. At least fifty such pigeons 37 can be stacked on the plate 38. Of course this amount can vary according to the height of the rack above which a charging station is defined as described herein below.

The plate 38 extends at each end into the recess defined by the flanges 94 and 95 of each of the U-section beams 33. Under this plate 38 a pair of sliders 39 is provided, one at each beam and both spring biased by means of springs 43, so that teeth 46 thereof normally project into spaces 34*a* of the respective rack 34. Slots 45 formed in the sliders 39 and pins 45*a* on the plate 38 connect the sliders 39 to the plate 38 so that the sliders can be manually pulled laterally outwardly to displace the teeth 46 out of the inserted position shown in FIG. 5. The biasing action of the springs 43 returns the sliders 39 into the inserted positions. This movement is supplemented by means of guide rods 44 each passing through a hole in a central transverse bar 42 anchored to arms 48 of the sliders 39 to avoid misalignment of the sliders and providing for the combined movement discussed below.

As best shown in FIG. 5, the slides project outwardly beyond the beams 33 and are provided with handles 40 on which the teeth 46 are formed. These teeth 46 are designed to engage the outer rack 34, while a latch device 47 engages each of the inner racks 35. These latch devices each comprise a bolt 82 displaceable horizontally beneath the plate 38 in which a compression spring 80 is recessed and connected to an upwardly protruding pin 81 of each bolt 82. The outer end 83 of each bolt 82 has an inclined face 84. The inclination of this face 84 insures that when an upward motion is imparted to the platform 36 the bolts 82 can be cammed inwardly against the force of the springs 80, returning immediately to the protruding position. In this manner the platform 36 can be raised step by step along the spaces 34*a* and 35*a* of the racks 34 and 35.

This motion is originated by the momentary lifting of the outer racks 34, which entrain the platform 36 through a distance D′ greater than the distance D equal to one step on the rack. As the outer teeth 46 of the sliders 39 also have inclined end faces 49, when these outer racks 34 are raised, this upward motion will be transmitted to the teeth 46 which, in turn, will transfer the upward movement to the entire platform 36, so that the bolts 82 will be pressed inwardly as they pass the web between adjacent holes or spaces 35. As soon as the springs 80 return the outer ends 83 to the extended position, these outer ends 83 will rest firmly on the web above the space 35*a* just left, thus preventing the platform from dropping back down. When the momentary lifting of the outer racks 34 ceases, they return to their lowered position, passing downwardly through a distance equal to (D′:D) past the teeth 46 and momentarily moving inwardly through a short distance d against the force of the springs 43. This movement is made in order to lift the entire stack of pigeons 37 after withdrawal of the uppermost pigeon 37 by the launching head 50, as fully explained below.

In order to index the outer racks 34 in this manner, a stepping device is provided as shown in FIG. 2. A pneumatic cylinder 85 is arranged to move a horizontal pivot profile 86 whose ends 90 engage under pins 91 on the upper ends of the outer racks 35, so that, on pivoting of the profile 86 on pivot lugs 89, the profile 86 raises the racks 34 through the distance D′ equal to slightly more than the spacing D(FIG. 5). The pivot lugs 89 are traversed by horizontally protruding ends of a rod 143 fixed to a plate 88 in turn extending between the beams 33. One of the pivot lugs 89 is provided with an extension arm 89*a* to the free end of which the piston rod 85*a* of the cylinder 85 is pivotally connected. When the cylinder 85 is pressurized the rod 85*a* thereof with extend and pivot the extension 89*a* upwardly. Thus the rest of the profile 86 to the other side of the axis defined by the rod 143 will pivot downwardly. Since the profile ends 90 are to the same side of the axis of the rod 143 as the extension 89*a*, these ends will pivot upwardly and lift the two racks 34 by their pins 91 through the distance D′ somewhat greater than the intertooth spacing D. Therefore each time the cylinder 85 is pressurized it will index the platform 86 one step upwardly, leaving it closer to the launch head 50 by the distance D between teeth 34 and equal to the overall height of a single pigeon 37.

Once the stack of pigeons 37 supported on the plate 38 is completely depleted, the user of the machine need merely pull the two handles 40 of the sliders 39 oppositely and outwardly through a distance substantially greater than that necessary to disengage the teeth 46 from the spaces 34*a*. Each rod 44 forms a lost-motion coupling between a respective one of the slides 39 and the opposite bolt 82 so that after each of the slides is displaced outwardly sufficiently to disengage its tooth 46 from the respective rack 34, the lost motion or play is overcome and further outward displacement causes the slider 39 through the rod 44 to pull the opposite bolt 82 out of engagement with its respective rack 35. FIG. 4 clearly shows how each rod 44 extends through both of the bars 42 with clearance and has a head 44*a* at its end opposite the respective bolt 82 which is spaced from the opposite bar 42 by a distance equal to slightly more than the travel d necessary for a tooth 46 to disengage from a rack 34.

Once the platform 36 has completely descended down a new stack of pigeons 37 can be set on the platform 36 with the witness disk of the lowermost pigeon 37 extending downwardly into the hole 38*a*.

In the manner described above the stack of flying targets 37 can be brought step by step up to the charging station at the top of the rack 30. This station allows forward swinging-out of the uppermost pigeon 37 through notches 96 formed in the flanges 94 of the U-section beams 33. When the uppermost target 37 arrives at this station it assumes a position suitable for picking up by the tip 144 of the launch head 50. As described more fully in the copending above-cited application the witness disk of each of these pigeons 37 is cylindrically stepped so that when stacked these pigeons nest in each other. The height of the stepped-in top part of each pigeon, which is directed downwardly and received in the underlying pigeon in the stack, is equal to less than the dimension D′, which is the vertical distance through which the platform 36 is stepped each time the cylinder 85 is pressurized, minus the dimension D, which is the vertical spacing between adjacent holes in the racks 34 and 35 and which is also the vertical spacing between the platform 36 after each stepping and its previous position. Thus as the platform rises up it presses the underside of the uppermost pigeon 37 onto the launch head 50, then drops back down through a distance equal to (D′−D) so that this picked-up uppermost pigeon 37 is left hanging on the launch tip 144 and is completely free of the rest of the stack. The shape of the pigeons therefore allows them to form a stable nested-together stack, and the slight falling-back of the platform 36 during each vertical indexing or stepping insures that the uppermost pigeon is neatly picked off and separated from the stack so that it can be swung fowardly out with its wing or propeller tips passing through the notches 96.

To this end the head 50 is constituted by an outer envelope or housing 51 of cylindrical shape centered on the axis 51a and having a closed rear end and an open front or lauch end, from which the tip 144 projects. It is the launch tip 144 of the head 50 that must descend at the charging station to pick up the uppermost target pigeon 77. In order to do so, the envelope 51 is provided with a central bracket ring 54, carrying diametrally opposed gudgeons 97 and 98 that define the horizontal axis 50A and extend into suitable journals 52 and 57, respectively, carried by the upper portions of the beams 33 at the axis 51A so the head 50 can move between an upper almost vertical launch position, as shown in FIG. 2, and a lower loading position, as shown in FIG. 1 with the axes 51A and 30A coincident.

Figure 7:
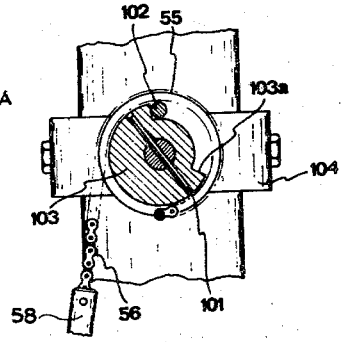
FIG. 7 is a section taken along line VII—VII of FIG. 6.

This tilting movement is effected by means of a pneumatic cylinder 53 (FIG. 2) whose piston rod 58 is connected to a chain 56 passing about a sprocket 55 and anchored thereon as shown in FIG. 7. The center of gravity of the head 50 is on the axis 51A but offset from the axis 50A toward the launch tip 144 so that this launch tip 144 will always fall downwardly from the near-vertical position shown in FIG. 2 to the position shown in FIG. 1 due to gravity when the cylinder 53 is depressurized. The cylinder 53 is set up so that on pressurization it retracts its rod 58, thus pulling the chain 56 and rotating said sprocket 55.

As a limit to the pivotal travel of the launch head 50 one of the journals 57 as shown in FIGS. 6 and 7 has a housing 99 receiving the respective gudgeon 98, internally coated with an anti-friction layer, and having a mouth provided with a plate 103 formed with a cutout 103*a* extending angularly over 120°. The plate 103 is fastened to the gudgeon 98 by a pin 101. A stop pin 102 parallel to the axis 50A is provided at the sprocket 55 and engages in the cutout 103*a* to define the end positions for the head 50.

As seen in FIG. 6 the stop 102 can be moved angularly to vary the end positions of the head 50 by loosening a clamping screw 102*a*. Thus when the chain 56 is pulled down by piston rod 58, the links thereof, in mesh with the teeth 100 of the sprocket, will rotate the plate 103 together with the gudgeon 98 to which it is anchored by the pin 101 into one of the end positions defined by the stop pin 102. When the cylinder 53 is depressurized, the weight of the heavy end of the launching head 50 itself will carry it suddenly into the downwardly directed loading position shown in FIG. 6.

When in the loading position, the cylinder 85 of the racks 34 is activated in order to move these racks 34 into the uppermost position, in which the uppermost target pigeon 37 is at the notches 96 of the charging station to press this uppermost pigeon 37 onto the tip 144 of the head 50 where it will be retained. As this movement is just momentary or transitory, return of the racks 34 into the rest position will separate the remaining target pigeons on the platform 36 from the one already picked up, thus permitting the head 50, upon activation of the cylinder 53, to be swiveled into the launch position, by passing the picked-up target 37 through the notches 96.

Figure 12:
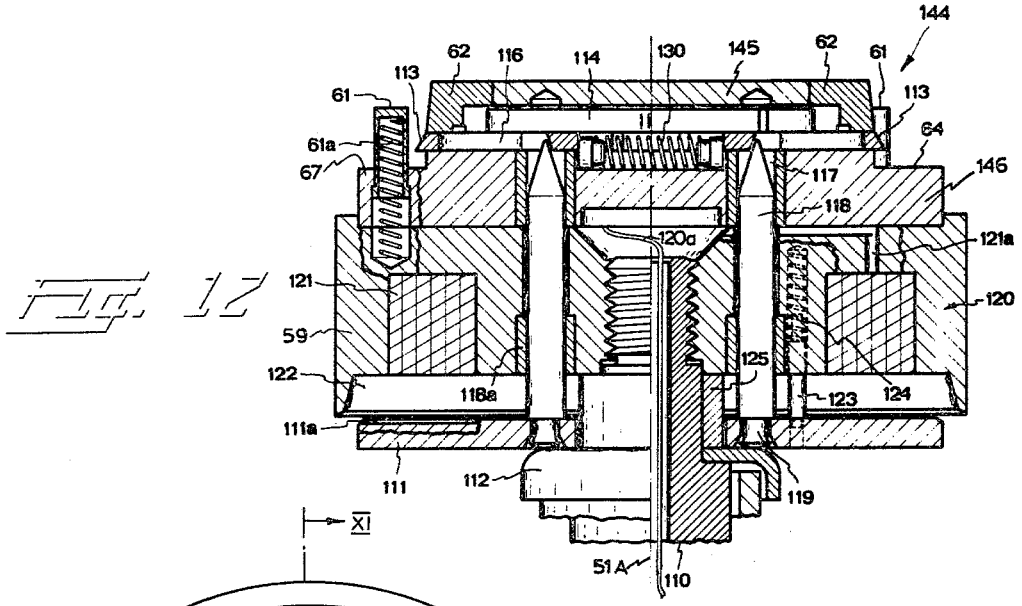
FIGS. 11 and 12 are sections taken along lines XI—XI and XII—XII of FIG. 10, respectively.
Figure 10:
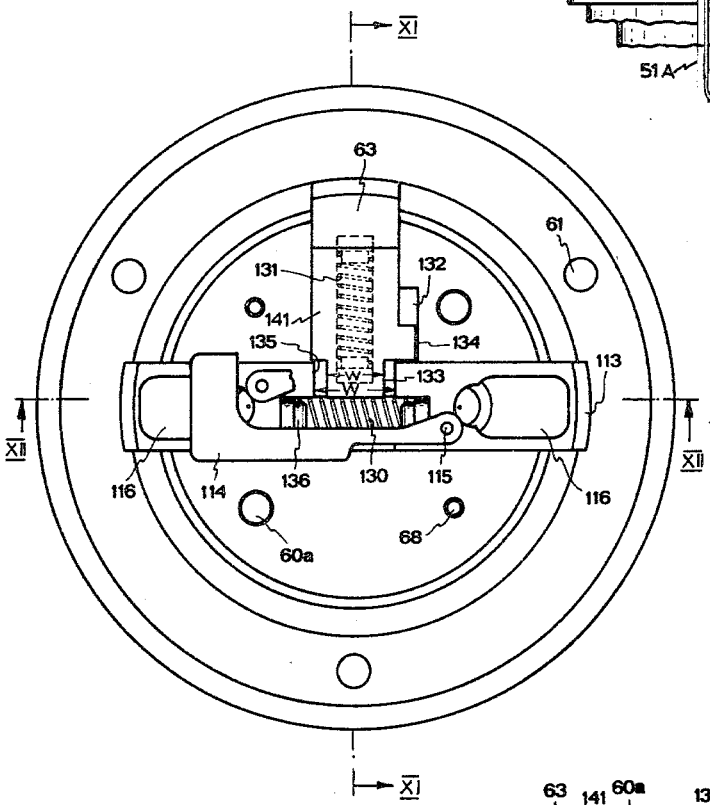
FIG. 10 is an axial end view of the launch head with parts removed to show the interior mechanism.

As seen in FIGS. 6 and 8–12 the launch tip 144 of the launch head 50 is basically formed by a circular generally frustoconical end plate 145 having a circular end face 60 lying in a plane perpendicular to the axis 51A, and by another cylindrical plate 146 formed with a right-angle step 64, and of an outside diameter slightly smaller than the inside diameter of the coreless target pigeon 37 securable thereto. This tip 144 is provided with three axially projecting disengaging pins 61 protruding at the step 64 and engageable with the ring of a target pigeon fitted over the tip 144. Springs 61*a* bias these hollow pins 61 axially outwardly as best seen in FIG. 12.

Figure 11:
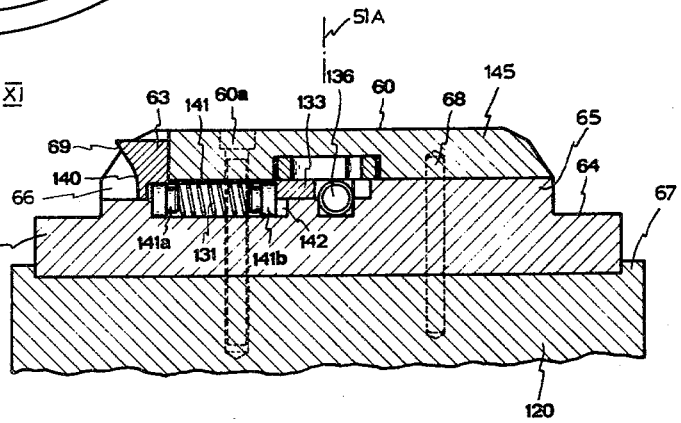

At a cylindrical side wall 65 defined by the step 64, there is provided a diametrically opposed pair of radially displaceable fingers 113, protruding radially outwardly. There is also a recess 66 offset by 90° to the fingers 113, from which a radially slidable beak 63 can protrude radially outwardly. As seen in FIG. 11, the beak 63 has a point 69, and an inner surface 140 terminating at the point and algnable flush at its base with the surface 65. This beak 63 is formed and functions as described in the copending application Ser. No. 679,135 mentioned above. Inside the recess and directed toward the axis 51A, the beak 63 is extended as a plate 141 formed with an axially backwardly open internal recess and ending in a solid portion 133 near the axis 51A. This internal recess or undercut is located above a matching internal recess 142 on the plate 146 formed with the step 64. Within these two undercuts, a compression spring 131 of the retraction type and having pushers 141*a* and 141*b* at its ends is housed. The lower recess or undercut 142 extends slightly beyond the pusher 141*b* to provide room enough for movement of the beak. The radially inner pusher 141*b* bears on the beak extension 141 and the radially outer pusher 141*a* on the plate 146 to normally urge the beak 63 radially inwardly.

The fingers 113 extend diametrally opposite each other and are spring biased radially outwardly by means of a central spring 130 (FIG. 10), carrying at its ends pushers 136. This spring 130 extends within a lower undercut of the plate 146 and mainly below the fingers 113. The fingers 113 extend to the center of the tip 144 within a suitable undercut formed in the end plate 145. Each finger is formed with an aperture 116 in the general shape of a keyhole. A pair of couterweights 114 overlie these recesses and are connected by pins 115 to the inner portions of the fingers 113. The internal portions of the fingers 113, a laterally extending portion 134 of the beak extension 141, and the rear portion 133 of the beak 63 extend coplanar to each other.

With the tip 144 at rest the fingers 113 will be always protruding and the beak will always be retracted. This rest position is the one suitable for pickup of the uppermost target pigeon at the charging station. Therefore when upward movement of the platform 36 presses the uppermost pigeon 37 against the launch tip 144 of the launch head 50 which in turn is directed downwardly with the axes 51A and 31A coaxial this upward pressure is enough to overcome the force of the spring and cam the fingers 113 momentarily inwardly as the ring of this pigeon passes these fingers 113. When the ring of the pigeon being picked up is completely past the fingers 113 and rests on the step 64 the fingers 113 will snap back to their protruding position and positively lock the pigeon on the tip 144.

The rear portion 133 has a transverse width w which is somewhat smaller than the distance W between the inner ends of the fingers 113 in the outer unactuated position thereof. It lies within the scope of the invention to increase the width of this rear portion 133 until it is equal to W so that the fingers 113 can only be retracted when the beak 63 and its plate 141 are in the outer position, which they only assume when the launch tip 144 is rotated at a sufficiently great speed that the radially outwardly effective centrifugal force is sufficient to compress the spring 131. Thus release of the picked-up pigeon prematurely, that is before the head is up to speed, is impossible. Such an arrangement necessitates deformation of the pigeon during loading, rather than pushing-in of the fingers 113.

In order to retract the fingers 113 from their extended positions, the tip 144 has a driving portion 59 formed as a solid portion immediately adjacent the step 64 and defining another similar step 67. Allen screws 60*a* and alignment pins 68 hold the plates 145 and 146 on the portion 59. This driving portion 59 is provided with an electromagnet 120 having an annular coil 121 centered on the axis 51A. Connecting cables 120*a* for the coil 121 pass through an axial passage 121*a* extending to the center of the body, and merging into a central hole coincident with the rotation axis 51A of the head. A plurality of pins 123 are axially slidable in the driving portion 59 and are biased backwardly and axially by springs 124. These pins 123 are fixed on a lower circular plate 111, the top surface of which is formed with slots 111*a*. Within this circular plate 111 are anchored lower ends 119 of axially extending pins 118 that extend from the plate 111 up to the vicinity of the keyhole apertures 116 of the fingers 113. The conically pointed top ends of these pins 118 pass through passages 117 and the tips thereof engage slightly within the keyhole apertures 116.

In the above arrangement, when the electromagnet 120 is energized by means of the coil 121, it will attract the lower circular plate 111 and move it axially forwardly against the force of the springs 124 that bias the pins 123 backwardly. In order to provide for this attraction, the lower end of the driving portion 59 is formed with an axially backwardly open recess 122 in which the plate 111 is receivable. This allows the plate to adhere to the back face of the electromagnet 120, thereby displacing the pins 118 axially forwardly and pressing the pointed ends thereof through the keyhole apertures 116. As the pins are received within anti-friction bushings, and since they cannot be radially or angularly deflected in the passages 117, the conical pointed ends thereof will cam the rear ends of both fingers radially inwardly against the force of the spring 130.

When this happens the free protruding ends of the fingers 113 will retract inside the plate 145, thereby disengaging themselves from the ring of the target pigeon. This ring is held on the step 64 against the force of the springs 61*a* biasing the pins 61 axially forwardly so that when the fingers 43 retract the pins 61 will spring axially forwardly out of the step 64 and push the target-pigeon ring and the entire pigeon from the launch head 50. As explained above, centrifugal force keeps the slidable beak 63 in its radially outwardly extended position thus allowing retraction of the fingers 113 as explained above. Rotation is transmitted to the launch tip 144 through the shaft 110 which is threaded into the portion 59 as shown in FIG. 12. In order to protect the junction between the launching tip and the shaft, a cover 112 is provided, fastened into place by means of a collar 125 for relatively watertight connection.

The shaft 110 is fixed on the output shaft of a motor (not shown), carried within the housing 51, and suitable to impart to the launch tip 144 high-speed rotation so that a target pigeon on the tip is spun fast enough to fly axially forwardly by itself from the beak when released thereby. Thus release of the pigeon from the beak is not effected smoothly, due to the provision of the shifting beak 62, which will remain extended through the inner portion of the flat ring of the pigeon. This pigeon, therefore, will follow the curve 140 (FIG. 11) of shifting beak for lateral deflection leaving the beak to alter unpredictably its trajectory of flight. As the speed at which the pigeon is rotating at the moment of release is rather high, such lateral displacement could alter the momentum of the pigeon in such a way that the center of gravity would wobble to the detriment of the stability of the pigeon. In order to avoid this, a pair of guide members 62 (FIG. 8) are provided diametrally opposite each other and partially protruding from the side wall 65 terminating at the step 64. The guide members 62 are 90° offset from the shifting beak 63, and precisely above the fingers 113. The side walls 62*a* of the guide members 62 are nontangent to the wall 65, but lie on a secant plane defining a chord for the circle segment thus secanted. These secant planes of both walls 62*a* converge relative to the axis 51A in the direction opposite that of the surface 140 of the shifting beaks 63. By this means, the two side walls 62*a* define guide planes for the inner edge of the flat ring of the target pigeon, as it slides forwardly on the curved surface 140 of the beaks 63, thus providing a more stable maintenance of the gravity center of the pigeon.

Turning now to FIGS. 1 and 2, the visual signal gate 70 is arranged atop the apparatus. This means consists of a flat plate 71 secured by a hinge 75 to the bent over lip 18 of the top platform 19. The hinge 75 is secured by means of nuts 107, for a pivotal movement of the plate 71 between an upright position as shown in FIG. 1, and a down position as shown in FIG. 2. This movement is obtained by means of a pneumatic cylinder 72, located beneath the platform 19 and having a piston rod 73 connected, by means of a lever 74 to the plate 71. The connection between the rod 73 and the lever 74 is pivotal so that when the rod is extended upwardly through the square opening 76 by the pressure inside the cylinder, the lever 74 fixed to a flange 74*a* located at a lower corner of the said plate 71 will pivot the plate 71 down. Preferably the piston 72 is of the single-action type, and is spring returned to its retracted rest position; although, of course, any other type could be employed.

Figure 13:
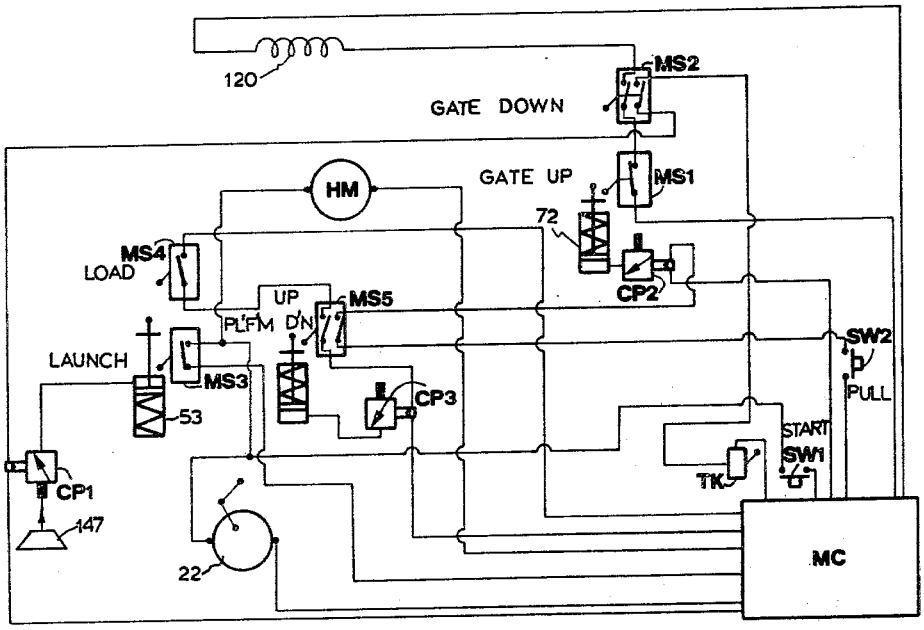
FIG. 13 (sheet 4) is circuit diagram for the launcher.

Either in the path of the piston rod or in the path of the plate 71, there is provided a pair of microswitches MS1 and 2 (FIG. 13). On pivoting down of the plate 71, these microswitches are actuated to close and open respective circuits. The first microswitch MS1 inergizes the head coil 120 in order to disengage the target pigeon for take off. The second microswitch MS2 deenergizes a circuit to depressurize the cylinder 53 in order to allow the head 50 to come to the charging position by gravity. As the head is now at rest (i.e., is not rotating) this can be effected.

The piston rod 58 of load cylinder 53 acts as shown in FIG. 13 on a normally open single-pole microswitch MS4 in the load position of the head 50 and at the end of its stroke. This switch MS4 energizes a circuit for the pressurization of the cylinder 85 for raising of the stack of target pigeons 37 to load the uppermost pigeon on the launch tip 144 at the charging station. On reaching the end of this movement the piston rod 85*a* of the cylinder 85 actuates a two-pole normally open microswitch MS5 to depressurize itself to drop the stack of pigeons to the rest position and to depressurize the cylinder 72 raise the plate 71 to its vertical position and, afterward, to de-energize the entire apparatus.

The various pneumatic cylinders 53, 72, and 85 are connected to a compressor 147 (FIG. 13) or other fluid source that maintains a predetermined pressure. The feeding of fluid under pressure into the cylinders is controlled by means of electropneumatic or electrohydraulic valves CP1, CP2, and CP3 energizable by the circuitry described above and below.

The operation of an apparatus of the invention is best understood with detailed reference to the circuit diagram of FIG. 13. The entire function of the apparatus is controlled by means of a master controller MC, in which a token-actuated switch TK is provided to start the operation of the master controller. As a result the head 50, normally at the lower loading position, is raised to the launch position shown in FIG. 2 by energization of the valve CP1 between the compressor 147 and the cylinder 53. At the same time, an automatic selector (not shown) at the master controller MC decides which of the launcher in the array will be actuated, without the knowledge either of the shooter or of the operator. The preferred number of apparatuses in the array is five, although this number can be varied, according to the desires or needs of a particular range. This is with the purpose of making the determination of where the target pigeon will fly up from more difficult, much as for a hunter who does not know where the prey is or nor where it will be flushed from.

A start pushbutton SW1 is then depressed and the launcher selected by the automatic selector (not shown) is started by energizing the motor HM of the head 50 to revolve at high speed, and by energizing also the motor-reductor motor 22 in order to start the back-and-forth movement of the apparatus. In this condition, the apparatus is ready to launch the pigeon. The shooter meanwhile is standing at the shooter's position of the range, and when he or she is ready to shoot, he or she will call "pull," whereupon an operator actuates the pushbutton of the "pull" or second switch SW2. This switch SW2 energizes the electropneumatic or electrohydraulic valve CP2 between the compressor 147 and the cylinder 72 in order to drop the plate 71 downwardly to the position shown in FIG. 2. The dropping of the normally erect plate 71 constituting the visual signal device 70 on the one hand shows the shooter which of the apparatuses in the array will launch the pigeon and on the other hand starts a sequence of events discussed hereinbelow.

As the plate 71 drops, the first normally open microswitch MS1 is actuated to close the circuit for the energization of the head coil 120. As discussed above this provides for retraction of the fingers 113 and allows for the takeoff of the spinning pigeon, and the deflection thereof as the curved surface 140 and the tip 69 of the shifting beak 63 contact it while it follows the guide surfaces of the side guides 62. As soon as this is effected the pigeon flies into the air and the shooter aims at it and fires his or her shotgun. Meanwhile the motor HM of the head 50 and the motor 22 have been stopped and the plate 71 continues its descent and, upon reaching the end thereof, a second two-pole normally closed microswitch MS2 is actuated to deenergize the valve CP1 between the compressor 147 and the cylinder 53 which is spring-biased to pull the chain 56 for tilting of the head 50 as explained above. Deenergization of the valve CP1 by the second microswitch MS2 empties the cylinder 53, in order to provide for the falling-down due to gravity of the head 50 into the load position. This is possible because the piston rod 73 has passed and reopened the first normally open microswitch MS1 and the motor HM of the head 50 has come to a stop. Upon continuing the run of piston rod 58 of the cylinder 53 the third microswitch MS4 is actuated thereby. As a consequence thereof the valve CP3 between the compressor 147 and the cylinder 85 is energized. As this cylinder 85 serves to displace the charging platform 36 upwardly by means of the outer racks 34, this energization will effect the charging of the next pigeon in the stack onto the launching tip. To do this, the uppermost pigeon 37 in the stack is pressed forcibly against the launching tip 144 which is directed downwardly so as to snap in the protruding fingers 113 and become seated against the force of the springs **61*a*. Since the lower face of the fingers 113 is flat and horizontal, the more force the springs 61*a* bring to bear against the underside of the pigeon, the stronger the retaining force; but when these fingers are retracted the pins 61** will move axially forwardly and thus aid in the releasing of the pigeon.

A fourth microswitch MS3 is provided to be actuated by the cylinder 53 only when the head 50 is in the launch position. This is a safety microswitch, which prevents starting of the motor HM and the motor 22 as long as the head 50 is not positioned to launch a pigeon. When reaching the launch position, the microswitch MS3 closes thus closing the circuit and allowing, upon actuation of the switch SW1, the motors 22 and HM to be started. Otherwise, such starting is impossible.

When the cylinder 85 reaches its end point, i.e. when a pigeon has been pressed onto the launch tip as already discussed, a fifth double-pole normally closed microswitch MS5 is actuated to deenergize the valve CP3 of the cylinder 85 in order to move same to its rest position, i.e. to provide for the slight half step descent of the platform 36 below the charging thus leaving just one pigeon at this station (the one already fastened to said head), and leaving room for withdrawal thereof through the notches 96 defining this station. At the same time, this microswitch MS5 deenergizes the valve CP2 of the cylinder 72 thus providing for the emptying thereof and the consequent pivoting up of the plate 71 to the vertical position shown in FIG. 1. This deenergizes all the devices and circuits in the apparatus, permitting the return of the apparatus to the stand-by or original position, in which a new token, inserted at the token-actuated switch TK, can restart the cycle.

In this arrangement the back pole of the microswitch MS5 prevents the valve CP2 from being actuated to pressurize the cylinder and drop the gate 70 except when the platform 36 is in the down position. The front pole of the microswitch MS2 prevents any accidental energization of the coil 120 which could cause a pigeon to be dropped; the coil can only be energized for a brief instant at the start of the dropping of the gate 70. The normally open microswitch MS4 only closes when the launch head 50 is in the load position, and the valve CP3 of the platform cylinder 85 can only be energized when this switch MS4 is closed, so the platform 36 cannot be stepped unless the head 50 is in a position ready to pick up a pigeon. Finally the motors 22 and HM can only be operated when the head 50 is in the launch position. Thus the device automatically protects itself from any type of nonsequential and unsafe operation. If any part of the cycle fails, the device will not be able to complete its cycle and therefore will operate in a very safe manner.

It can be seen from the above that the automatic apparatus of this invention is capable of loading itself with a plurality of target pigeons, one at the time, by proceeding through the series of stages and steps as above disclosed, launching them at the desired moment with an unpredictable trajectory. Also, the apparatus of this invention can be used either individually or grouped with other similar apparatuses in a given array. In the first instance, the remote-control terminal would contain simply a first pushbutton to carry the head to the near-vertical position, a second pushbutton to start the revolution of the head and the back-and-forth motion of the assembly, plus a "pull" button to energize the electromagnet and carry the signal gate downwardly and rearwardly which, in turn, starts the series of energizations for the completely automatic operation of the apparatus. It is also contemplated by this invention that a single button can effect, sequentially, the energization of the cylinder pivoting the head to the launching position and the starting of th head motor and the motor-reductor. In this case, the remote control would imply the use of the master control as above described. In both instances, the sequence of the thus induced movements and energizations, would be substantially the same.

It is within the provisions of this invention, that an "empty" switch be added, in order to prevent a launching apparatus from following the launching sequence without being loaded with a pigeon thereon. Also a visible and/or audible warning can be used to alert the operator of the missing target situation. All this can be done in a way easily determined by those skilled in the art.

As those skilled in the art can also easily realize, various changes and modifications can be made in the above. Further to those already mentioned, other equivalents to those already pointed out can be brought into practice, without departing from the scope of the invention. All of the above disclosure, as well as the features illustrated in the drawings, are illustrative, rather than limitative, since the only limits to the scope of the invention are defined in the following claims.

I claim:

1. In combination with a target pigeon having a central ring from which outwardly extend a pair of propeller-type vanes, a launcher comprising:

a frame;

a vertically displaceable platform on said frame adapted to support a stack of the target pigeons;

a launch head on said frame above said platform pivotal about a horizontal swivel axis and having a launch tip shaped to fit within the ring of any of said pigeons and rotatable about a head axis transverse to said swivel axis;

swivel means between said head and said frame for pivoting said head about said swivel axis between a launch position with said tip directed generally upwardly and a load position with said tip directed downwardly at said platform;

platform drive means between said platform and said frame for vertically displacing said platform in a succession of steps and for fitting the uppermost pigeon of said stack over said tip when said head is in said load position;

holding means on said tip including at least one positive locking element for releasably securing a pigeon whose ring has been fitted over said tip to said tip; and head drive means connected to said tip for spinning same about said head axis in said launch position, whereby a pigeon secured by said locking element to said head when same is spinning and in said launch position can be released by said locking element and will then fly upwardly away from said head.

2. The launch defined in claim 1, wherein said tip is provided with a beak displaceable between an outer position projecting radially from said tip and oriented to deflect a pigeon moving along said head axis off said tip and an inner position retracted into said tip, and with retraction means for displacing said beak into said inner position when said head is in said loading position.

3. The launch defined in claim 2 wherein said retraction means includes biasing means continuously urging said beak with a relatively light force radially inwardly on said tip into said retracted position, whereby when said tip is rotated said beak is urged radially outwardly with a centrifugal force considerably greater than said light force.

4. The launch defined in claim 3 wherein said tip has a substantially cylindrical outer surface of a diameter slightly smaller than the internal diameter of one of said rings, said beak projecting radially beyond said surface only in said outer position.

5. The launch defined in claim 3 wherein said locking element is a radially displaceable finger on said tip, and said holding means includes a solenoid in said head operatively connected to said finger for radially displacing same between a protruding position projecting radially from said tip and a retracted position within said tip.

6. The launch defined in claim 5 wherein said solenoid includes a coil fixed in and rotatable with said tip and an armature plate axially displaceable on but rotatable jointly with said tip.

7. The launch defined in claim 6 wherein said holding means includes a cam axially displaceable jointly with said armature plate and operatively engageable with said finger.

8. The launch defined in claim 7 wherein said cam is an axially extending pin having a pointed end and said finger is formed with a cam formation engageable with said pointed end.

9. The launch defined in claim 8 wherein said finger lies generally to one side of said head axis and is provided with a counterweight lying generally to the opposite side of said head axis.

10. The launch defined in claim 8 wherein said tip is provided with two such fingers diametrically opposite each other.

11. The launch defined in claim 6, further comprising a spring radially biasing said finger continuously into said protruding position.

12. The launch defined in claim 1, further comprising at least one ejector body on said tip displaceable in line with said head axis and means for biasing said ejector body into a position projecting from said tip and bearing axially on a ring of a pigeon held thereon.

13. The launch defined in claim 12 wherein said ejector body is an axially displaceable pin and said means for biasing is a spring braced between said pin and said tip.

14. The launcher defined in claim 1 wherein said tip is provided with a radially projecting deflecting beak and angularly offset from said beak with steadying formations oriented so that said ring rides over said formations as the respective pigeon moves off said tip.

15. The launcher defined in claim 1 wherein said head drive means includes an electric motor in said head and swivelable jointly therewith.

16. The launcher defined in claim 1, further comprising means for oscillating said head about a vertical axis when in said launch position.

17. The launcher defined in claim 1 wherein said platform drive means includes a fixed rack defining for said platform a plurality of positions vertically offset from each other by a predetermined spacing equal generally to the overall height of one of said pigeons.

18. The launcher defined in claim 17 wherein said platform drive means includes lift means for raising said platform during each of said steps through a distance somewhat greater than said spacing and for thereafter allowing said platform to drop back down by a distance substantially smaller than said spacing.

19. The launcher defined in claim 18 wherein said lift means includes a movable rack adjacent said fixed rack, and a pair of horizontally displaceable latch bolts on said platform each engageable with a respective one of said racks.

20. The launcher defined in claim 19 wherein said bolts having faces inclined to the vertical and engageable with the respective racks, and are provided with spring means urging the bolts horizontally into engagement with the respective racks.

21. The launcher defined in claim 20 further comprising manually operable means on said platform for displacing both of said bolts out of engagement with the respective racks for manual vertical displacement of said platform.

22. The launcher defined in claim 1 wherein said frame includes a pair of U-section upright means spaced apart and dimensioned to embrace the tips of the vanes of a stack of said pigeons on said platform between said beams, said beams being formed with notches at a charging station immediately below said head, a pigeon secured to said tip passing through said notches swiveling of said head between said load and launch positions.

23. The launcher defined in claim 22 wherein said platform is guided on said beams.

24. The launcher defined in claim 1, further comprising signal means including a gate carried on said frame and displaceable thereon between an up position and a down position, and gate drive means for displacing said gate between said positions.

25. The launcher defined in claim 24, further comprising control means including a master controller remote from said frame and connected to said drive means and including at least one switch operable by said gate.

* * * * *